US009376128B2

(12) United States Patent
Paulino et al.

(10) Patent No.: US 9,376,128 B2
(45) Date of Patent: Jun. 28, 2016

(54) SYSTEM AND METHOD FOR REMOTELY CONTROLLING A VEHICLE CONSIST

(71) Applicant: General Electric Company, Schenectady, NY (US)

(72) Inventors: Carlos Sabino Paulino, Melbourne, FL (US); Derek Kevin Woo, Melbourne, FL (US); Robert Carmen Palanti, Melbourne, FL (US); Ralph Caswell Haddock, III, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 205 days.

(21) Appl. No.: 14/156,537

(22) Filed: Jan. 16, 2014

(65) Prior Publication Data

US 2014/0277845 A1 Sep. 18, 2014

Related U.S. Application Data

(60) Provisional application No. 61/784,704, filed on Mar. 14, 2013.

(51) Int. Cl.
*B61L 3/12* (2006.01)
*B61C 17/12* (2006.01)

(52) U.S. Cl.
CPC *B61L 3/127* (2013.01); *B61C 17/12* (2013.01)

(58) Field of Classification Search
None
See application file for complete search history.

(56) References Cited

U.S. PATENT DOCUMENTS

| | | | | |
|---|---|---|---|---|
| 7,430,967 | B2 | 10/2008 | Kumar | |
| 8,280,567 | B2 | 10/2012 | Brand | |
| 8,328,144 | B2 | 12/2012 | Smith | |
| 8,328,145 | B2 | 12/2012 | Smith | |
| 8,380,361 | B2 | 2/2013 | Evans | |
| 8,406,943 | B2 | 3/2013 | Brand | |
| 2007/0233335 | A1 * | 10/2007 | Kumar | B61L 3/006 701/22 |
| 2008/0269967 | A1 * | 10/2008 | Kumar | B61L 27/0027 701/20 |
| 2009/0076667 | A1 * | 3/2009 | Otsubo | B61L 3/006 701/2 |
| 2011/0060486 | A1 * | 3/2011 | Meltser | B61C 17/12 701/19 |
| 2011/0183605 | A1 * | 7/2011 | Smith, Jr. | B61L 5/0027 455/7 |
| 2011/0249628 | A1 | 10/2011 | Peltz | |
| 2012/0303187 | A1 * | 11/2012 | Sexauer | B61L 25/028 701/19 |
| 2014/0239127 | A1 * | 8/2014 | Morris | B61C 17/12 246/182 B |

* cited by examiner

*Primary Examiner* — John R Olszewski
*Assistant Examiner* — James M McPherson
(74) *Attorney, Agent, or Firm* — GE Global Patent Operation

(57) ABSTRACT

A method for remotely controlling a vehicle system includes selectively identifying, among two or more consists in the vehicle system, a selected consist to remotely control. Each of the two or more consists including a propulsion-generating vehicle. The method also includes initiating remote control of the propulsion-generating vehicle in the selected consist and remotely controlling at least one of tractive effort or braking effort provided by the propulsion-generating vehicle in the selected consist using a remote control device. The at least one of tractive effort or braking effort provided by the propulsion-generating vehicle in the selected consist is controlled without remotely controlling tractive effort or braking effort provided by the propulsion-generating vehicle in at least one other consist in the vehicle system.

21 Claims, 4 Drawing Sheets

SYSTEM AND METHOD FOR REMOTELY CONTROLLING A VEHICLE CONSIST

CROSS-REFERENCE TO RELATED APPLICATIONS

This application claims priority to U.S. Application No. 61/784,704, filed on 14 Mar. 2013, and titled "System And Method For Remotely Controlling A Vehicle Consist," the entire disclosure of which is incorporated by reference.

FIELD

Embodiments of the inventive subject matter described herein relate to remotely controlling a vehicle consist.

BACKGROUND

A vehicle consist is group of two or more vehicles mechanically coupled or linked together to travel along a route. One type of rail vehicle consist is a train, which may include one or more locomotives and one or more rail cars that carry cargo. When loading and unloading trains carrying cargo such as coal or iron ore, railroad companies may bring the trains through a tunnel where the loading and unloading of cargo occurs as the train moves at a pre-determined speed.

Currently known systems are limited in that the systems only have the capability of controlling the leading locomotive of a consist. Difficulties arise when the terrain in the tunnel has inclines, the leading locomotive malfunctions, or spatial adjustments are necessary to correctly position a particular remote locomotive or car for the loading or unloading of cargo operation.

For example, only being able to control the leading locomotive during loading and unloading may result in difficulties involved in generating sufficient tractive effort to climb the inclines and/or move through the tunnel if the leading locomotive malfunctions. These difficulties can be significantly time consuming and, as a result, negatively impact the revenue stream of the railroad companies.

BRIEF DESCRIPTION

In an embodiment, a method (e.g., for remotely controlling a vehicle system) includes selectively identifying, among two or more consists in the vehicle system, a selected consist to remotely control. Each of the two or more consists including a propulsion-generating vehicle. The method also includes initiating remote control of the propulsion-generating vehicle in the selected consist and remotely controlling at least one of tractive effort or braking effort provided by the propulsion-generating vehicle in the selected consist using a remote control device. The at least one of tractive effort or braking effort provided by the propulsion-generating vehicle in the selected consist is controlled without remotely controlling tractive effort or braking effort provided by the propulsion-generating vehicle in at least one other consist in the vehicle system.

In an embodiment, this method includes identifying, with an off-board control unit configured for selective individual control as between plural consists in a vehicle system, a selected consist to remotely control. (Selective individual control means the off-board control unit can remotely control first a first consist, and then a second consist, and then a third consist (if applicable), and so on, based on a selection as between the plural consists.) For example, the control unit can switch between which of the consists are to be controlled by the control unit while the other consists are not controlled by the control unit.

In an embodiment, a control system includes an off-board controller configured to identify a selected sub-consist in a vehicle consist to remotely control. The vehicle consist includes the selected sub-consist and at least one other sub-consist. The selected sub-consist and the at least one other sub-consist each include a propulsion-generating vehicle. The controller is configured to initiate remote control of the propulsion-generating vehicle in the selected sub-consist and to remotely control at least one of tractive effort or braking effort provided by the propulsion-generating vehicle in the selected sub-consist. The at least one of tractive effort or braking effort provided by the propulsion-generating vehicle in the selected sub-consist being controlled without also remotely controlling tractive effort or braking effort provided by the propulsion-generating vehicle in the at least one other sub-consist.

In an embodiment, a control system includes an input device and a controller. The input device is configured to receive a selection of a first sub-consist in a vehicle consist having the first sub-consist and at least a second sub-consist. Each of the first and second sub-consists including a propulsion-generating vehicle. The controller is configured to receive the selection of the first sub-consist from the input device and to wirelessly transmit data signals to the first sub-consist to independently control at least one of tractive effort or braking effort provided by the propulsion-generating vehicle of the first sub-consist without also remotely controlling tractive effort or braking effort provided by the propulsion-generating vehicle in the second sub-consist.

BRIEF DESCRIPTION OF THE DRAWINGS

Reference is now made briefly to the accompanying drawings, in which.

DETAILED DESCRIPTION

Figure 1:
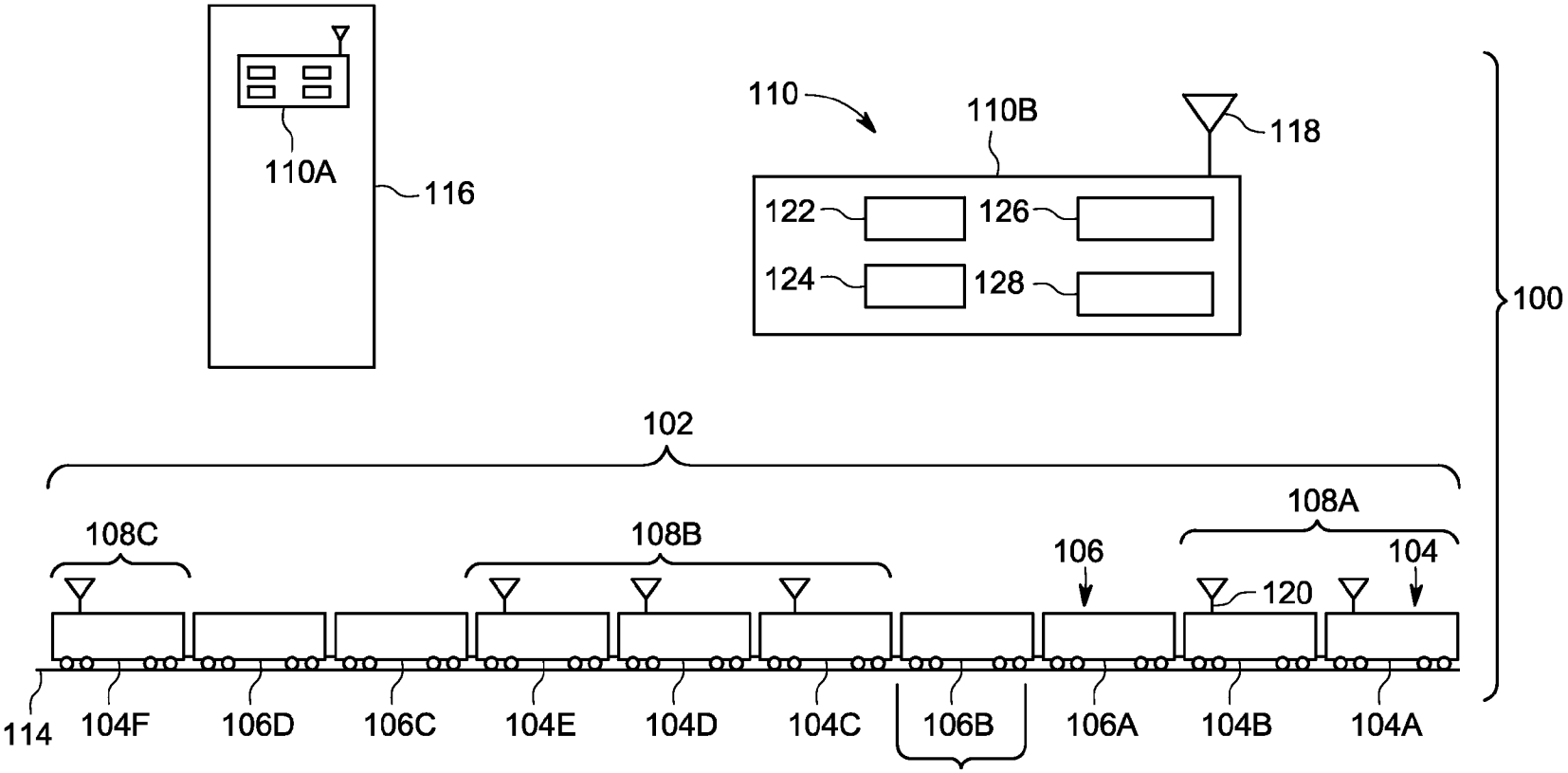
FIG. 1 is a schematic view of an embodiment of a control system for remotely controlling a vehicle consist.

In accordance with one or more embodiments described herein, systems and methods are provided for independently controlling vehicle consists within a larger vehicle system from a remote location, such as a vehicle yard tower, a hand-held remote control unit, or the like. A vehicle "consist" includes a group of one or more vehicles that are mechanically coupled or linked together to travel along a route. In one aspect, a vehicle system includes two or more vehicle consists, which may be directly connected to each other or may be connected to each other but separated by one or more other vehicles. One type of vehicle system is a rail vehicle consist, such as a train, which can include one or more locomotives (or other propulsion-generating rail cars or vehicles) organized into locomotive consists and one or more non-propulsion-generating rail cars or vehicles. Although one or more embodiments are described herein in connection with rail vehicles and rail vehicle consists, not all embodiments are to be so limited. One or more embodiments may apply to other types of vehicles and vehicle consists, such as off-highway vehicles other than rail vehicles (e.g., vehicles that are not designed or permitted to travel on public roadways), automobiles, marine vessels, and the like.

When loading and unloading vehicle systems carrying cargo (e.g., minerals such as coal or iron ore), the vehicle systems may travel through a tunnel where the loading and unloading operation occurs while the vehicle system moves at a pre-determined (e.g., designated) speed. This speed may differ (e.g., be slower than) a speed limit of the route, and may not be associated with any slow work orders or any other temporary restrictions on the speed of travel through a segment of the route. In one aspect of the inventive subject matter described herein, the tractive efforts and/or braking efforts of any vehicle consist in the vehicle system can be independently controlled from a remote location, such as a building (e.g., a yard tower), a mobile operator remote control unit, and the like. This independent control of the tractive efforts and/or braking efforts of consists in a vehicle system can allow for an operator to remotely control the independently controlled vehicle consist to travel at a designated speed (e.g., a loading or unloading speed for respectively loading cargo onto the consist or unloading cargo from the consist), even in situations where the terrain over which the loading or unloading occurs includes uphill and/or downhill grades, and/or where one or more propulsion-generating vehicles malfunction or otherwise become unable to generate sufficient tractive effort to propel the vehicles at the designated speed or unable to generate sufficient braking effort to slow the vehicles to the designated speed. Additionally or alternatively, the independent control of the consists can allow for an operator to remotely control the locations of the consists relative to each other within the vehicle system. This independent control of locations of the consists may be needed to position a non-propulsion-generating vehicle (e.g., a cargo or passenger car) in a designated location for the loading and/or unloading of cargo or passengers to occur.

As one example, if a lead propulsion-generating vehicle (e.g., along a direction of travel of the vehicle consist) malfunctions, then at least one embodiment of the systems and methods described herein will allow other propulsion-generating vehicles (e.g., remote locomotives) to push the vehicle system through a tunnel or other location where loading and/or unloading of cargo or passengers occurs. This can reduce the down time that would be otherwise needed to replace the lead propulsion-generating vehicle. Similarly, and in cases where the terrain over which loading and/or unloading occurs is uneven, the amount of propulsive force or braking force provided by any selected consist can be individually adjusted to drive the consist at a particular or designated speed through a tunnel or other loading/unloading location. If adjustment in the position of one or more non-propulsion-generating vehicles (e.g., cargo or passenger cars) needs to be modified, the remote control system or device can have the capability of controlling the propulsion and/or braking of any particular consist while keeping the other propulsion-generating vehicles in the same vehicle system in idle (e.g., not generating propulsive force, but may otherwise be activated or in an ON mode) in order to correctly position a particular car or cars for the loading or unloading of cargo and/or passengers to occur.

FIG. 1 is a schematic view of an embodiment of a control system 100 for remotely controlling a vehicle system 102. The items shown in the Figures are not drawn to scale. The vehicle system 102 includes several propulsion-generating vehicles 104 (e.g., vehicles 104A-F) that are mechanically connected (e.g., via couplers) with non-propulsion-generating vehicles 106 (e.g., vehicles 106A-D). The propulsion-generating vehicles 104 and non-propulsion-generating vehicles 106 are illustrated as locomotives and rail cars, respectively, but alternatively may represent other vehicles or types of vehicles. The number and/or arrangement of the vehicles 104, 106 are provided merely as examples and are not limiting on all embodiments of the inventive subject matter described herein.

The propulsion-generating vehicles 104 are arranged in consists 108 consists 108 (e.g., consists 108 consists 108A-C). In the illustrated embodiment, the consist 108A includes two propulsion-generating vehicles 104A, 104B, the consist 108B includes three propulsion-generating vehicles 104C, 104D, 104E, and the consist 108C includes one propulsion-generating vehicle 104F. Alternatively, a different number of consists 108 consists 108 may be provided and/or the number of propulsion-generating vehicles 104 in one or more of the consists 108 may be different from what is shown in FIG. 1. The consists 108 are separated from each other by one or more of the non-propulsion-generating vehicles 106. The non-propulsion-generating vehicles 106 may carry cargo and/or passengers.

Remote control devices 110 (e.g., devices 110A-B) are disposed off-board (e.g., remote from) the vehicle system 102 and allow operators to control operations of the vehicle consist 102 without the operators and/or devices 110 being onboard the vehicle system 102. In FIG. 1, the device 110A is shown in a building 116, such as a vehicle yard tower, dispatch center, maintenance facility, or other location. The device 110B may be a mobile device, such as a hand held operator control device, that may be carried by a human operator without aid of another machine or apparatus.

The devices 110 and propulsion-generating vehicles 104 include communication devices 118, 120, such as transceiver devices (and associated hardware and/or software), that allow for the wireless communication of data signals between the devices 110 and the vehicles 104. The data signals may include instructions sent to the propulsion-generating vehicles 104 to control tractive efforts and/or braking efforts provided by the propulsion-generating vehicles 104. The data signals may additionally or alternatively include reporting information sent to the devices 110 in order to notify the devices 110 of the states of the propulsion-generating vehicles 104, such as locations of, tractive efforts being provided by, braking efforts provided by, and/or malfunctions of the propulsion-generating vehicles 104.

The remote control devices 110 can allow for the operators to select any of the consists 108 to control the tractive and/or braking efforts provided by the consist 108 that is selected. For example, the remote control devices 110 may control the operations of a consist 108 other than the lead consist (e.g., the consist that is at the front or leading end of the vehicle system 102 and/or that controls operations of other consists, such as when the vehicle system 102 is operating in a distributed power state or configuration). The remote control devices 110 can include memories 122 that store information used to control the propulsion-generating vehicles 104. The memories 122 may be internal to the devices 110, or external to the devices 110 with the devices 110 having access to the information stored in the memories 122. The information stored in the memories 122 may include the locations of communication-restricted areas along the route 114, uphill grades of the route 114, downhill grades of the route 114, load/unload segments 112 of the route 114, designated speeds or ranges of speed for the vehicle system 102 to travel along the route 114, sizes (e.g., mass and/or length) of the vehicles 104, 106 and/or vehicle system 102, power outputs of the propulsion-generating vehicles 104, identifications of which propulsion-generating vehicles 104 are disposed in which consists 108, locations of the consists 108 in the vehicle system 102, and the like.

The remote control devices 110 can control any of the consists 108 to move the vehicle system 102 through a cargo loading and/or unloading segment 112 of a route 114 being traveled by the vehicle system 102. For example, one or more of the remote control devices 110 can select one of the consists 108A, 108B, or 108C and independently control the tractive efforts and/or braking efforts provided by the propulsion-generating vehicles 104 in the selected consist 108. Additionally or alternatively, the devices 110 can select two or more (but less than all) of the consists 108 and independently control the tractive efforts and/or braking efforts provided by the propulsion-generating vehicles 104 in the selected consists 108 at the same time (e.g., concurrently or simultaneously). In one aspect, the devices 110 can select individual ones of the propulsion-generating vehicles 104 within one or more of the consists 108 and individually control the tractive efforts and/or braking efforts of the selected propulsion-generating vehicles 104. By independently control, it is meant that the operations (e.g., tractive efforts and/or braking efforts) of one consist 108 and/or propulsion-generating vehicle 104 can be controlled without regard to and/or without being based on (e.g., proportional to or otherwise change in response to) the operations and/or changes in operations of any other consist 108 and/or propulsion-generating vehicle 104 in the same consist 108 and/or vehicle system 102.

The devices 110 can include or be coupled with input devices 124 that receive user input from one or more operators. The input device 124 can represent buttons, levers, switches, touchscreens, an electronic mouse, stylus, microphone, or the like, that is used by an operator to remotely control operations of the propulsion-generating vehicles 104. The devices 110 include controllers 126 that may represent one or more logic-based devices, such as one or more circuits or circuitry (or other hardware) that includes or is connected with one or more processors, microcontrollers, or the like. The controllers 126 are used to control operations of the devices 110, such as by interpreting input received by the input device 124, generating and transmitting control signals based on this input to the propulsion-generating vehicles 104 via the communication devices 118, and the like. The devices 110 may include output devices 128, such as a display screen, speaker, or other device that communicates information to operators of the devices 110. For example, the output devices 128 can be used to notify operators of when communication with one or more propulsion-generating vehicles 104 is lost or is likely to be lost, upcoming features of interest in the terrain of the route 114 (e.g., uphill and/or downhill grades, speed limits or restrictions, loading/unloading segments 112 of the route 114, or the like), messages received from the propulsion-generating vehicles 104, and the like.

The loading/unloading segment 112 of the route 114 represents a location where cargo and/or passengers are loaded onto or unloaded from the vehicle system 102. For example, loading equipment such as cranes that load or unload cargo, dumping containers (that hold and dump cargo into the non-propulsion-generating vehicles 106), raised passenger platforms (where passengers stand before getting onto the non-propulsion-generating vehicles 106 and/or exit onto from the non-propulsion-generating vehicles 106), or another location. In order to load or unload cargo and/or passengers from a non-propulsion-generating vehicle 106 (e.g., the non-propulsion-generating vehicle 106B), the vehicle system 102 may need to be positioned along the route 114 such that the non-propulsion-generating vehicle 106B is located within the load/unload segment 112. If the non-propulsion-generating vehicle 106B is not located within the load/unload segment 112, such as when all or a portion of the non-propulsion-generating vehicle 106B is outside of the load/unload segment 112, then cargo and/or passengers may not be able to be loaded into or unloaded from the non-propulsion-generating vehicle 106B.

In some aspects, the vehicle system 102 may be able to continue moving through and relative to the load/unload segment 112 at the same time that the cargo or passengers are loaded or unloaded from one or more of the non-propulsion-generating vehicles 106. For example, when the non-propulsion-generating vehicle 106A moves through and is located within the load/unload segment 112, cargo and/or passengers may be loaded onto or unloaded from the non-propulsion-generating vehicle 106A. When the non-propulsion-generating vehicle 106B moves through and is located within the load/unload segment 112, cargo and/or passengers may be loaded onto or unloaded from the non-propulsion-generating vehicle 106B as the vehicle system 102 continues to move relative to the load/unload segment 112. Similarly, when the non-propulsion-generating vehicle 106C moves through and is located within the load/unload segment 112, cargo and/or passengers may be loaded onto or unloaded from the non-propulsion-generating vehicle 106C as the vehicle system 102 continues to move relative to the load/unload segment 112.

In order to load or unload cargo or passengers onto or from the non-propulsion-generating vehicles 106 as the vehicle system 102 moves relative to the load/unload segment 112, the speed of the vehicle system 102 may be limited. For example, the vehicle system 102 may need to travel at a designated speed or within a designated range of speeds so that the cargo or passengers may be safely loaded onto or unloaded from the non-propulsion-generating vehicles 106. This designated speed or range of speeds may differ from other speed limits of the route 114, such as governmental or agency-enacted speed limits, slow orders for sections of the route 114 due to damage to the route 114 and/or ongoing maintenance on the route 114, or the like.

The remote control devices 110 can select one or more consists 108 consists 108 and/or one or more propulsion-generating vehicles 104 in the vehicle system 102 to individually control the tractive efforts and/or braking efforts of the selected consist 108 and/or propulsion-generating vehicle 104 in order to move and/or position the non-propulsion-generating vehicles 106 for loading/unloading cargo or passengers in the load/unload segment 112. A remote control device 110 can select one consist 108 to control while the propulsion-generating vehicles 104 in the other consists 108 consists 108 are separately controlled (e.g., automatically controlled according to a predetermined plan or rules, or manually controlled). Additionally or alternatively, the remote control device 110 can select a consist 108 to control while the propulsion-generating vehicles 104 in the other consists 108 consists 108 automatically turn to idle, where the propulsion-generating vehicles 104 may remain ON (e.g., to generate electric current via an engine-generator set) but do not generate tractive effort to propel the vehicle system 102.

The remote control device 110 can be used to select a consist 108 to control responsive to a determination that one or more propulsion-generating vehicles 104 have malfunctioned and/or are unable to generate sufficient tractive effort and/or braking effort to control movement of the vehicle system 102. For example, one or more of the propulsion-generating vehicles 104A-B in the leading consist 108A may become damaged or otherwise unable to generate sufficient tractive effort to propel the vehicle system 102 to a position where one or more designated ones of the non-propulsion-generating vehicles 106 is located within the load/unload segment 112 of the route 114. The loss of the tractive effort that would otherwise be provided by these propulsion-generating vehicles 104A-B may prevent the vehicle system 102 from being pulled to a location where one or more of the non-propulsion-generating vehicles 106 is located in the load/unload segment 112. The remote control device 110 can increase the tractive effort generated by one of the other propulsion-generating vehicles 104C-F (such as the propulsion-generating vehicles 104C-E) such that the total tractive effort provided by the vehicle system 102 is sufficient to move the designated non-propulsion-generating vehicle 106 to the load/unload segment 112. The tractive effort of the selected propulsion-generating vehicle(s) 106C-F may be increased independent of the tractive efforts provided by one or more of the other propulsion-generating vehicles 106A-B.

As another example, one or more of the propulsion-generating vehicles 104A-B in the leading consist 108A may become damaged or otherwise unable to generate sufficient braking effort to stop movement of the vehicle system 102 at a position where one or more designated ones of the non-propulsion-generating vehicles 106 is located within the load/unload segment 112 of the route 114. The loss of the braking effort that would otherwise be provided by these propulsion-generating vehicles 104A-B may prevent the vehicle system 102 from being stopped at a location where a designated one of the non-propulsion-generating vehicles 106 is located in the load/unload segment 112.

The remote control devices 110 can select one or more consists 108 consists 108 and/or one or more propulsion-generating vehicles 104 in the vehicle system 102 to individually control the tractive efforts and/or braking efforts of the selected consist 108 and/or propulsion-generating vehicle 104 in order to move the non-propulsion-generating vehicles 106 through the load/unload segment 112 at a designated speed or within a designated range of speeds, such as a speed that is sufficiently slow to allow for the loading or unloading of cargo or passengers. Additionally or alternatively, the remote control devices 110 can select one or more consists 108 consists 108 and/or one or more propulsion-generating vehicles 104 in the vehicle system 102 to individually control the tractive efforts and/or braking efforts of the selected consist 108 and/or propulsion-generating vehicle 104 in order to move the non-propulsion-generating vehicles 106 through the load/unload segment 112 at a designated speed or within a designated range of speeds, such as at a speed that is no faster than a speed limit.

A remote control device 110 can select a consist 108 (e.g., the consist 108C) to control while the propulsion-generating vehicles 104 in the other consists 108 consists 108 are separately controlled or turned to idle. One or more of the propulsion-generating vehicles 104 in the selected consist 108 may be independently controlled to increase the tractive efforts and/or decrease the braking efforts provided by the selected consist 108 in order to speed up the vehicle system 102. Alternatively, one or more of the propulsion-generating vehicles 104 in the selected consist 108 may be independently controlled to decrease the tractive efforts and/or increase the braking efforts provided by the selected consist 108 in order to slow down the vehicle system 102.

Figure 2:
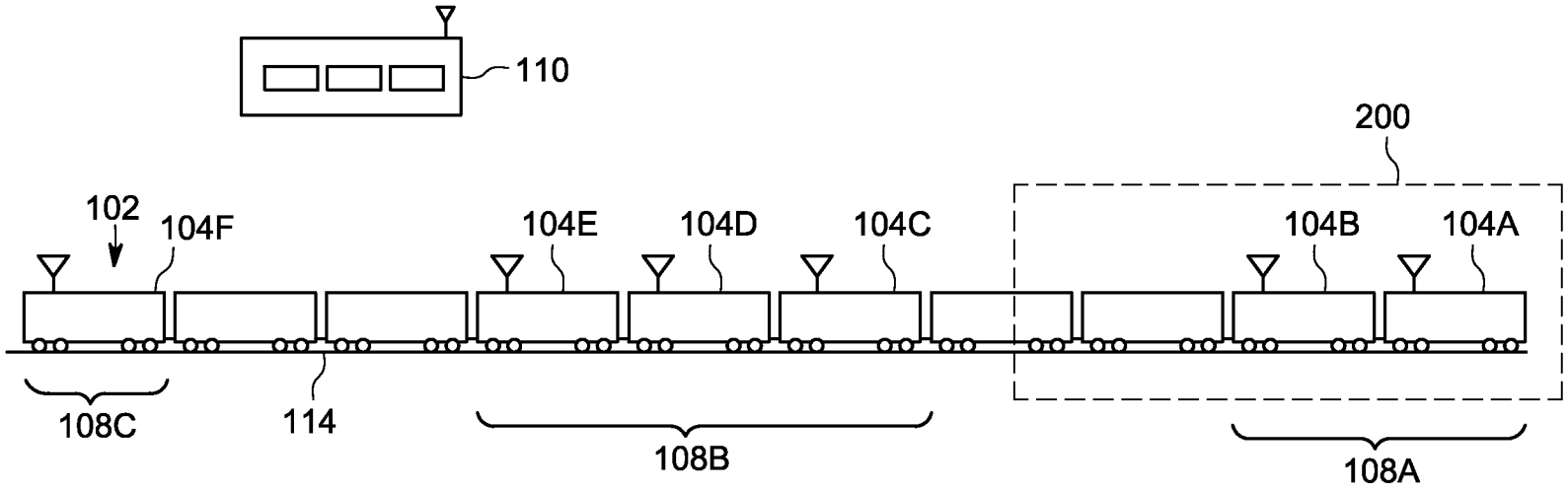
FIG. 2 is a schematic diagram of an embodiment of the vehicle consist shown in FIG. 1 entering a communication-restricted area.

FIG. 2 is a schematic diagram of an embodiment of the vehicle system 102 entering a communication-restricted area 200. The communication-restricted area 200 represents a geographic location or group of locations (e.g., a three-dimensional zone or area) in which communication may be limited, prevented, or restricted. For example, when the first consist 108A or at least one of the propulsion-generating vehicles 104A-B in the first consist 108A enters into the area 200, the remote control device 110 that was wirelessly communicating with the propulsion-generating vehicles 104A-B to control movement of the vehicles 104A-B may no longer be able to communicate with the vehicles 104A and/or 104B in order to control the vehicles 104A and/or 104B. The area 200 can represent a tunnel, valley, urban area, or other location that is at least partially enclosed such that wireless communication with the propulsion-generating vehicles 104 that are in the area 200 may be prevented (e.g., transmission and/or receipt of messages does not or cannot occur) or impeded (e.g., transmission and/or receipt of portions of the messages, but not entire messages, may occur; Quality of Service decreases below a designated, non-zero threshold; communication bandwidth drops below a designated, non-zero threshold; or the like) by structures. As another example, the area 200 may represent locations where wireless communication with the vehicles 104 in the area 200 is prevented or impeded due to interference (e.g., electromagnetic interference) with messages transmitted to the vehicles 104 and/or messages transmitted by the vehicles 104.

The device 110 may detect when one or more of the propulsion-generating vehicles 104 enters into the area 200 and the device 110 is no longer able to control operations of the vehicles 104 that are in the area 200. For example, the device 110 may send wirelessly send control messages to the propulsion-generating vehicles 104 and the vehicles 104 may send reply messages to the device 110 in response thereto. If the device 110 does not receive the reply message within a designated time period and/or does not receive at least a designated number of reply messages after multiple attempts to send the control message to the propulsion-generating vehicles 104, the device 110 may determine that communication with these propulsion-generating vehicles 104 is prevented or impeded.

In response to this determination, the device 110 may independently control operations of one or more other consists 108 consists 108 in the vehicle system 102. For example, if communication with the leading consist 108A is prevented or impeded, then the device 110 may select the second consist 108B and/or 108C to independently control. The device 110 may then control tractive efforts and/or braking efforts of the propulsion-generating vehicles, 104C, 104D, 104E in the consist 108B and/or the propulsion-generating vehicle 104F in the consist 108C. The device 110 can independently control the tractive efforts and/or braking efforts of the selected consist 108 in order to make up for the lost tractive efforts and/or braking efforts that otherwise would have been provided by the consist 108A and/or propulsion-generating vehicles 104A and/or 104B with which communication is prevented or impeded.

In one aspect, the device 110 can predict when communication with one or more of the consists 108 consists 108 will be or is likely to be lost, and select another consist 108 to independently control in response thereto. For example, the memory 122 (shown in FIG. 1) may store information on locations of communication-restricted areas, such as the area 200. The device 110 may track the speed and/or locations of the vehicle system 102 such that the device 110 can determine or estimate when the vehicle system 102 will enter into the area 200. Prior to the leading consist 108A entering into this area 200 or when the consist 108A is estimated to have entered into this area 200, the device 110 can begin independently controlling the tractive efforts and/or braking efforts of another sub-consist, such as the consist 108B and/or 108C, as described above.

Figure 3:
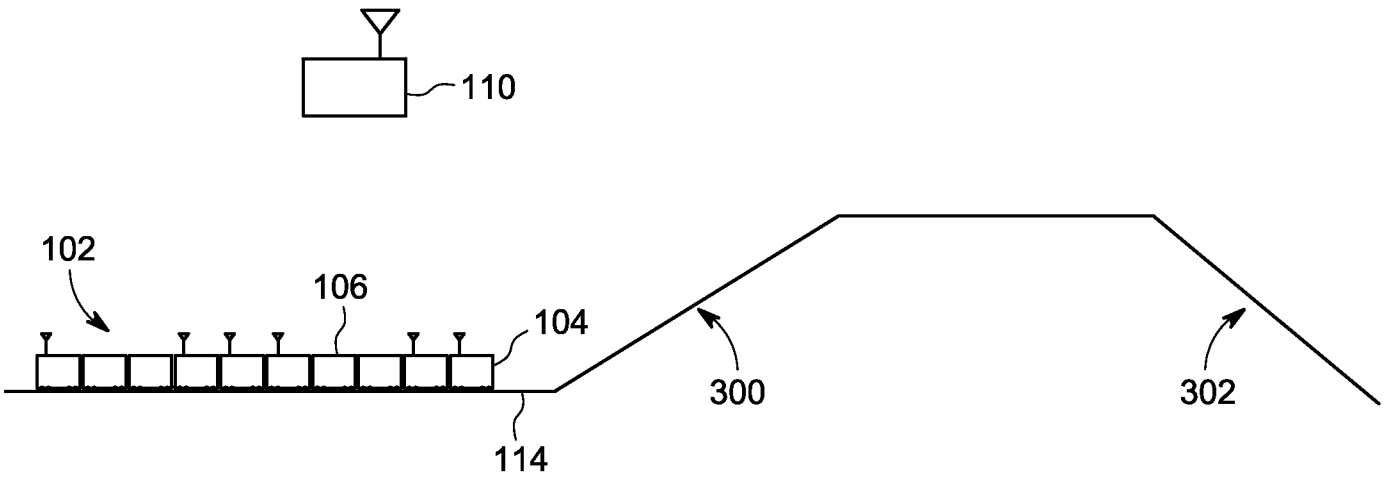
FIG. 3 is a schematic diagram of an embodiment of the vehicle consist shown in FIG. 1 approaching an uphill grade and a downhill grade.

FIG. 3 is a schematic diagram of an embodiment of the vehicle system 102 approaching an uphill grade 300 and a downhill grade 302. The uphill grade 300 represents an inclined segment of the route 114 toward which the vehicle system 102 is traveling and the downhill grade 300 represents a declined segment of the route 114 toward which the vehicle system 102 is traveling. The uphill grade 300 and/or the downhill grade 302 may be disposed inside the communication-restricted area 200 in one aspect. Alternatively, the uphill grade 300 and/or the downhill grade 302 may be disposed outside of the area 200.

The device 110 may determine when the vehicle system 102 is approaching or will reach the uphill and/or downhill grades 300, 302 and notify the operator. The operator may use the device 110 to select one or more of the consists 108 consists 108 to independently control in order to ensure that the vehicle system 102 traverses the uphill and/or downhill grade 300, 302 with limits. These limits may include restrictions on speed of the vehicle system 102 (e.g., for loading and/or unloading, as described above), restrictions on the amount of coupler forces between the vehicles 104, 106, restrictions on locations of the vehicles 104 and/or 106 (e.g., to position a cargo car within the loading/unloading segment 112 of the route 114 shown in FIG. 1), and the like.

For example, as the vehicle system 102 approaches the uphill grade 300, the device 110 may be used to independently control the propulsion-generating vehicles 104 in the consist 108B and/or 108C to propel the vehicle system 102 up the uphill grade 300. The device 110 may direct the propulsion-generating vehicles 104 in the consist 108B and/or 108C to increase the tractive efforts provided from these vehicles 104 to ensure that the vehicle system 102 is generating sufficient tractive effort to traverse the uphill grade 300 without exceeding speed restrictions and/or causing one or more of the non-propulsion-generating vehicles 106 to be out of position (e.g., out of the loading/unloading segment 112 of the route 114). If communication with one or more of the consists 108 consists 108 is lost, then the device 110 can select another consist 108 to control such that the vehicle system 102 is still able to travel up the uphill grade 300.

As another example, as the vehicle system 102 approaches the downhill grade 302, the device 110 may be used to independently control the propulsion-generating vehicles 104 in the one or more of the consists 108 consists 108 to control descent of the vehicle system 102 down the downhill grade 302. The device 110 may direct the propulsion-generating vehicles 104 in the consist 108A to decrease tractive effort and/or increase braking effort when the consist 108A is approaching or descending the downhill grade 302. Additionally or alternatively, the device 110 may direct the propulsion-generating vehicles 104 in the consist 108B and/or 108C to decrease tractive effort and/or increase braking effort when the vehicle system 102 is approaching or descending the downhill grade 302.

Figure 4:
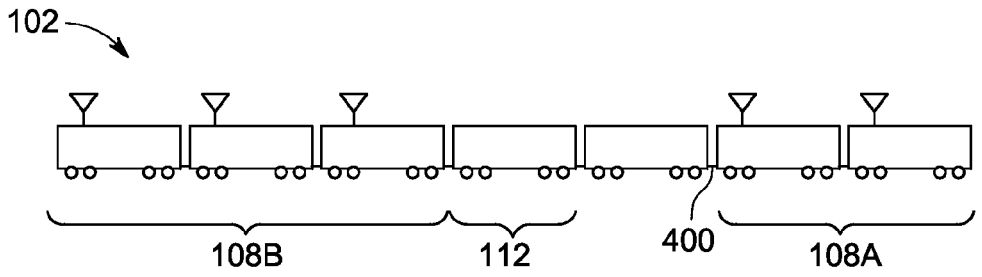
FIG. 4 is a schematic diagram of a portion of the vehicle consist shown in FIG. 1.
Figure 5:
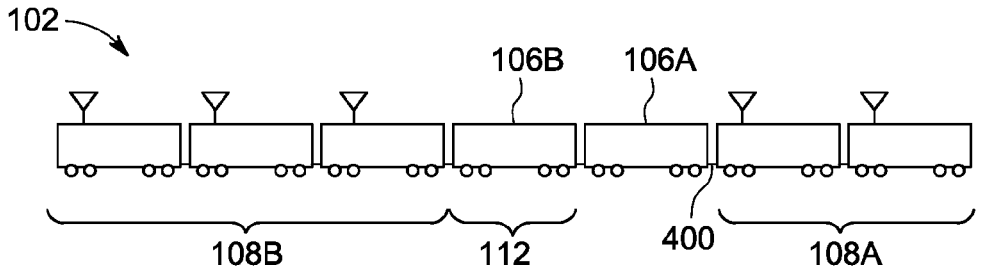
FIG. 5 is another schematic diagram of a portion of the vehicle consist shown in FIG. 4.

FIGS. 4 and 5 are schematic diagrams of a portion of the vehicle system 102. The portion of the vehicle system 102 that is shown in FIGS. 4 and 5 includes the consists 108 consists 108A, 108B and non-propulsion-generating vehicles 106A, 106B disposed between the consists 108 consists 108A, 108B. In the illustrated example, different pairs of adjacent vehicles 104, 106 in the vehicle system 102 are separated by different distances due to different amounts of stretch in couplers 400 disposed between the vehicles 104, 106. As shown in FIG. 4, the separation distance between the non-propulsion-generating vehicles 106A and 106B is larger than the separation distance between the propulsion-generating vehicles 104B and the non-propulsion-generating vehicle 106A, and is larger than the separation distance between the non-propulsion-generating vehicle 106B and the propulsion-generating vehicle 104C. For example, the coupler 400 between the vehicles 106A and 106B is stretched longer than the coupler 400 between the vehicles 106B and 106A and the coupler 400 between the vehicles 106B and 104C.

Due to these separation distances, the non-propulsion-generating vehicle 106B is not positioned within the loading/unloading segment 112 of the route 114. The remote control device 110 may be used to individually control the propulsion-generating vehicles 104 in the consists 108 consists 108A and/or 108B to position the on-propulsion-generating vehicle 106E in the loading/unloading segment 112. For example, the device 110 may direct one or more (or all) of the propulsion-generating vehicles 104C-E in the consist 108B to generate tractive effort. This tractive effort may decrease the separation distance between the non-propulsion-generating vehicles 106A, 106B. Additionally or alternatively, the device 110 may direct the propulsion-generating vehicle 104F to generate tractive effort to decrease the separation distance between the non-propulsion-generating vehicles 106A, 106B. Additionally or alternatively, the device 110 may direct one or more of the propulsion-generating vehicles 104A and/or 104B to generate tractive effort in a reverse direction to decrease the separation distance between the non-propulsion-generating vehicles 106A, 106B. As shown in FIG. 5, decreasing this separation distance can result in the non-propulsion-generating vehicle 106B to be positioned within the loading/unloading segment 112 of the route 114.

Figure 6:
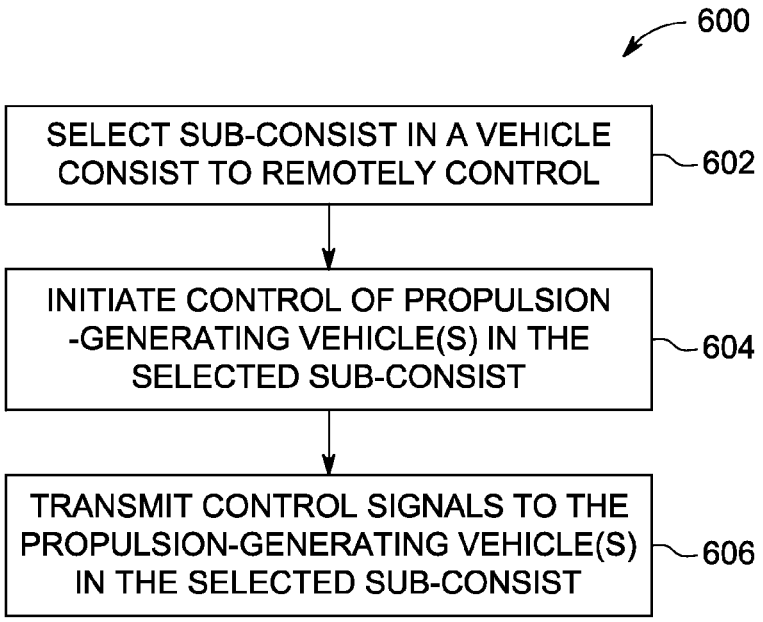
FIG. 6 illustrates a flowchart of an embodiment of a method for controlling a vehicle consist.

FIG. 6 illustrates a flowchart of an embodiment of a method 600 for controlling a vehicle consist. The method 600 may be used in conjunction with one or more embodiments of the control system 100 and the vehicle system 102 described above. For example, the method 600 may be used to independently control operations of a sub-consist in a vehicle consist from a remote location.

At 602, a sub-consist in a vehicle consist is selected for being remotely controlled. For example, the consist 108A, 108B, or 108C may be selected for being remotely controlled by the remote control device 110. In one aspect, two or more, but less than all, of the consists 108 consists 108 in the vehicle system 102 may be selected for being remotely controlled. Additionally or alternatively, one or more propulsion-generating vehicles 104 in the vehicle system 102 may be selected for being remotely controlled by the remote control device 110. In one aspect, all of the propulsion-generating vehicles 104 in a consist 108 may be selected for being remotely controlled, or less than all of the propulsion-generating vehicles 104 in a consist 108 may be selected for being remotely controlled.

The sub-consist and/or propulsion-generating vehicles may be manually selected. For example, a human operator of the remote control device 110 may select the consist 108 or propulsion-generating vehicles 104 to control with the device 110 by providing input via the input device. The operator may select the consist 108 or vehicles 104 from a list, image, or the like. Optionally, the sub-consist and/or propulsion-generating vehicles may be automatically selected. For example, the controller 126 of the device 110 may estimate the inertia of the vehicle system 102 from the information stored in the memory 122 and use the inertia to determine whether control of one or more consists 108 consists 108 and/or propulsion-generating vehicles 104 should be taken over by the device 110. The controller 126 may determine that the vehicle system 102 has too much inertia (or too little inertia) and likely will move too quickly (or too slowly) through the loading/unloading segment 112 of the route 114, likely will move past a location where a designated one of the non-propulsion-generating vehicles 106 is outside of the loading/unloading segment 112, likely will not move far enough to position the designated non-propulsion-generating vehicle 106 in the loading/unloading segment 112, likely will not have sufficient inertia to traverse an uphill grade, likely will have too much inertia when traveling down a downhill grade (such that coupler forces may become too large and/or a speed limit is violated), or the like.

From this determination, the controller 126 may notify the operator of the device 110 (e.g., via the output device 126) and may suggest one or more of the consists 108 consists 108 and/or propulsion-generating vehicles 104 to be controlled by the device 110 such that the inertia of the vehicle system 102 can be decreased or increased as needed to comply with speed restrictions, position a designated non-propulsion-generating vehicle 106 in the loading/unloading segment 112, traverse a downhill or uphill grade safely, and the like. Alternatively, the controller 126 may automatically select the consist 108 and/or propulsion-generating vehicles 104. For example, if the inertia of the vehicle system 102 is too great, the controller 126 may recommend selecting a sub-consist that is positioned in the vehicle system 102 to apply braking effort such that the inertia of the vehicle system 102 is decreased. As another example, if the inertia is too small, the controller 126 may recommend selecting a sub-consist that is positioned in the vehicle system 102 to apply tractive effort such that the inertia of the vehicle system 102 is increased.

The controller 126 may automatically suggest or automatically select a consist 108 or propulsion-generating vehicles 104 responsive to the controller 126 determining that communication between the device 110 and one or more consists 108 consists 108 and/or propulsion-generating vehicles 104 is lost or impeded. For example, if the controller 126 determines that communication between the device 110 and the consists 108 consists 108A, 108B is prevented (e.g., the consists 108 consists 108A, 108B do not respond to messages from the device 110 within a designated time or after a designated number of attempts), the controller 126 may suggest to the operator or that the device 110 begin controlling another sub-consist, such as the consist 108C. Additionally or alternatively, the controller 126 may automatically take control of the other sub-consist.

At 604, remote control of the selected sub-consist is initiated. For example, control of the tractive efforts and/or braking efforts of the propulsion-generating vehicles 104 in the selected consist 108 may be at least partially transferred to the remote control device 110. By partially transferred, it is meant that some aspects of control (such as emergency braking or other safety controls) may remain with the propulsion-generating vehicles 104. Control of the vehicles 104 in the selected consist 108 may be transferred to the device 110 by the device 110 transmitting a signal to the propulsion-generating vehicles 104 in the selected consist 108 that informs the vehicles 104 that the device 110 will be remotely controlling the vehicles 104. The vehicles 104 may perform one or more checks to authenticate the device 110 and to check to see if the device 110 has proper permissions to control the vehicles 104. The vehicles 104 may respond by transmitting a confirmation message to the device 110.

At 606, the tractive efforts and/or braking efforts of the propulsion-generating vehicle(s) in the selected sub-consist are independently controlled by the remote control device. As described above, the device 110 can independently control the operations of these vehicles 104 by controlling the vehicles 104 without regard to the operations of one or more (or all) other propulsion-generating vehicles 104 in the vehicle system 102 (e.g., the vehicles 104 outside of the selected consist 108). The device 110 can remotely control the propulsion-generating vehicles 104 in the selected consist 108 to control the speed and/or position of the vehicle system 102, as described above. The device 110 can control these vehicles 104 by wirelessly transmitting signals to the vehicles 104.

In an embodiment, a method (e.g., for remotely controlling a vehicle system) includes selectively identifying, among two or more consists in the vehicle system, a selected consist to remotely control. Each of the two or more consists including a propulsion-generating vehicle. The method also includes initiating remote control of the propulsion-generating vehicle in the selected consist and remotely controlling at least one of tractive effort or braking effort provided by the propulsion-generating vehicle in the selected consist using a remote control device. The at least one of tractive effort or braking effort provided by the propulsion-generating vehicle in the selected consist is controlled without remotely controlling tractive effort or braking effort provided by the propulsion-generating vehicle in at least one other consist in the vehicle system. In an embodiment, this method includes identifying, with an off-board control unit configured for selective individual control as between plural consists in a vehicle system, a selected consist to remotely control. (Selective individual control means the off-board control unit can remotely control first a first consist, and then a second consist, and then a third consist (if applicable), and so on, based on a selection as between the plural consists.) For example, the control unit can switch between which of the consists are to be controlled by the control unit while the other consists are not controlled by the control unit.

In one aspect, identifying the selected consist includes selecting a consist other than a lead consist of the vehicle system to remotely control when the vehicle system is operating in a distributed power (DP) configuration.

In one aspect, the at least one of tractive effort or braking effort provided by the propulsion-generating vehicle in the selected consist is remotely controlled independent of the tractive effort or the braking effort provided by the propulsion-generating vehicle in the at least one other consist in the vehicle system.

In one aspect, the vehicle system includes a non-propulsion-generating vehicle configured to carry at least one of cargo or passengers. The at least one of tractive effort or braking effort provided by the propulsion-generating vehicle in the selected consist is remotely controlled to position the non-propulsion-generating vehicle in a segment of a route used to one or more of load the at least one of cargo or passengers onto the non-propulsion-generating vehicle or unload the at least one of cargo or passengers from the non-propulsion-generating vehicle.

In one aspect, identifying the selected sub-consist includes determining when the at least one other consist in the vehicle system is or will be in a communication-restricted area along a route being traveled by the vehicle system where remote control of the at least one other consist is prevented.

In one aspect, the method also includes determining when the vehicle system is approaching a segment of interest of a route being traveled by the vehicle system that includes at least one of an uphill grade or downhill grade. Identifying the selected consist can occur responsive to the determining and remotely controlling the at least one of tractive effort or braking effort includes remotely controlling the selected consist such that the vehicle system travels over the segment of interest in the route at a designated speed.

In one aspect, the selected consist and the at least one other consist in the vehicle system are separated by at least a non-propulsion-generating vehicle, and remotely controlling at least one of tractive effort or braking effort provided by the propulsion-generating vehicle in the selected consist includes changing a position of the at least a non-propulsion-generating vehicle relative to the selected consist and the at least one other consist.

In one aspect, the at least one of tractive effort or braking effort provided by the propulsion-generating vehicle of the selected sub-consist is remotely controlled from a stationary building.

In one aspect, the at least one of tractive effort or braking effort provided by the propulsion-generating vehicle of the selected sub-consist is remotely controlled from a mobile handheld operator unit.

In one aspect, switching the at least one of the propulsion-generating vehicles in the selected consist to the remote control operating mode occurs responsive to identifying that a leading consist is or will be in the location where remote control of the leading consist is prevented.

In one aspect, the location where remote control of the leading consist is prevented includes a tunnel.

In one aspect, identifying the selected consist includes determining when an additional consist in the vehicle system malfunctions and is incapable of generating sufficient tractive effort to propel the additional consist.

In one aspect, the at least one of tractive effort or braking effort is remotely controlled from a location that is off-board the vehicle system.

In one aspect, remotely controlling the at least one of tractive effort or braking effort includes controlling a position of the selected sub-consist relative to the at least one other consist in the vehicle system.

In one aspect, the method also includes remotely switching the at least one other consist in the vehicle system to an idle operating mode such that the at least one other consist withholds applying the tractive effort or the braking effort while the position of the selected consist is changed relative to the at least one other consist.

In one aspect, the vehicle system does not include a model train.

In one aspect, one or more of identifying the selected consist, initiating the remote control, or remotely controlling the at least one of tractive effort or braking effort is performed by one or more processors.

In an embodiment, a control system includes an off-board controller configured to identify any one of two or more consists in a vehicle system as a selected consist to remotely control. Each of the consists include a propulsion-generating vehicle. The controller is configured to initiate remote control of the propulsion-generating vehicle in the selected consist and to remotely control at least one of tractive effort or braking effort provided by the propulsion-generating vehicle in the selected consist. The at least one of tractive effort or braking effort provided by the propulsion-generating vehicle in the selected consist being controlled without also remotely controlling tractive effort or braking effort provided by the propulsion-generating vehicle in the at least one other consist in the vehicle system.

In one aspect, the controller is configured to identify a consist other than a lead consist of the vehicle system to remotely control when the vehicle system is operating in a distributed power (DP) configuration.

In one aspect, the controller is configured to remotely control the at least one of tractive effort or braking effort provided by the propulsion-generating vehicle in the selected consist independent of the tractive effort or the braking effort provided by the propulsion-generating vehicle in the at least one other consist.

In one aspect, the vehicle system includes a non-propulsion-generating vehicle configured to carry at least one of cargo or passengers, and the controller is configured to remotely control the at least one of tractive effort or braking effort provided by the propulsion-generating vehicle in the selected consist in order to position the non-propulsion-generating vehicle in a segment of a route used to one or more of load the at least one of cargo or passengers onto the non-propulsion-generating vehicle or unload the at least one of cargo or passengers from the non-propulsion-generating vehicle.

In one aspect, the controller is configured to identify the selected consist by determining when the at least one other consist is or will be in a communication-restricted area along a route being traveled by the vehicle system where remote control of the at least one other consist is prevented.

In one aspect, the controller is configured to determine when the vehicle system is approaching a segment of interest of a route being traveled by the vehicle system that includes at least one of an uphill grade or downhill grade. The controller also can be configured to identify the selected consist responsive to the controller determining that the vehicle system is approaching the segment of interest.

In one aspect, the controller is configured to remotely control the at least one of tractive effort or braking effort provided by the propulsion-generating vehicle in the selected consist such that the vehicle system travels over the segment of interest in the route at a designated speed.

In one aspect, the selected consist and the at least one other sub-consist are separated by at least a non-propulsion-generating vehicle, and the controller is configured to remotely control the at least one of tractive effort or braking effort provided by the propulsion generating vehicle in the selected consist by changing a position of the at least a non-propulsion-generating vehicle relative to the selected consist and the at least one other consist.

In one aspect, the controller is configured to remotely control the at least one of tractive effort or braking effort provided by the propulsion-generating vehicle of the selected consist from a stationary building.

In one aspect, the controller is included in a mobile handheld operator unit.

In an embodiment, a control system includes an input device and a controller. The input device is configured to receive a selection of any one of plural consists in a vehicle system having at least a first consist and a second consist. Each of the first and second consists includes a propulsion-generating vehicle. The controller is configured to receive the selection of the first consist from the input device and to wirelessly transmit data signals to the first consist to independently control at least one of tractive effort or braking effort provided by the propulsion-generating vehicle of the first consist without also remotely controlling tractive effort or braking effort provided by the propulsion-generating vehicle in the second consist.

In one aspect, the controller is configured to transmit the data signals to increase the tractive effort provided by the propulsion-generating vehicle in the first consist to compensate for a decrease in the tractive effort provided by the propulsion-generating vehicle in the second consist due to a loss in communication with the propulsion-generating vehicle in the second consist.

In one aspect, the controller is configured to transmit the data signals to increase the braking effort provided by the propulsion-generating vehicle in the first consist to compensate for a decrease in the braking effort provided by the propulsion-generating vehicle in the second consist due to a loss in communication with the propulsion-generating vehicle in the second consist.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc, are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the inventive subject matter and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, processors or memories) may be implemented in a single piece of hardware (for example, a general purpose signal processor, microcontroller, random access memory, hard disk, circuitry, and the like). Similarly, the programs may be stand alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present inventive subject matter are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

What is claimed is:

1. A method comprising:

determining that a first propulsion-generating vehicle in a vehicle system is no longer communicable with from a location that is off-board the vehicle system to remotely control tractive effort or braking effort of the first propulsion-generating vehicle, wherein the vehicle system also includes a non-propulsion-generating vehicle;

identifying a second propulsion-generating vehicle in the vehicle system to remotely control; and positioning the non-propulsion-generating vehicle at a designated location by remotely controlling at least on of tractive effort or braking effort provided by the second propulsion-generating vehicle using a remote control device that is off-board the vehicle system, wherein the at least on of tractive effort or braking effort provided by the second propulsion-generating vehicle is remotely controlled by the remote control device without remotely controlling the tractive effort or the braking effort provided by the first propulsion-generating vehicle in the vehicle system with the remote control device.

2. The method of claim 1, wherein identifying the second propulsion-generating vehicle includes selecting a propulsion-generating vehicle in a consist other than a lead consist of the vehicle system as the second propulsion-generating vehicle to remotely control while the vehicle system is operating in a distributed power (DP) configuration.

3. The method of claim 1, wherein the at least one of tractive effort or braking effort provided by the second propulsion-generating vehicle is remotely controlled independent of the tractive effort or the braking effort provided by the first propulsion-generating vehicle in the vehicle system.

4. The method of claim 1, wherein the non-propulsion-generating vehicle is configured to carry at least one of cargo or passengers, and the at least one of tractive effort or braking effort provided by the second propulsion-generating vehicle is remotely controlled to position the non-propulsion-generating vehicle at the designated location, wherein the designated location is located in a segment of a route used to one or more of load the at least one of cargo or passengers onto the non-propulsion-generating vehicle or unload the at least one of cargo or passengers from the non-propulsion-generating vehicle.

5. The method of claim 1, wherein determining that the first propulsion-generating vehicle can no longer be communicated with from the location that is off-board the vehicle system to remotely control the tractive effort or the braking effort of the first propulsion-generating vehicle includes determining when at least one consist in the vehicle system is or will be in a communication-restricted area along a route being traveled by the vehicle system where remote control of the at least one consist from the remote control device is prevented.

6. The method of claim 1, further comprising determining that the vehicle system is approaching a segment of interest of a route being traveled by the vehicle system that includes at least one of an uphill grade or downhill grade, wherein identifying the second propulsion-generating vehicle occurs responsive to determining that the vehicle system is approaching the segment of interest of the route and remotely controlling the at least one of tractive effort or braking effort includes remotely controlling the second propulsion-generating vehicle such that the vehicle system travels over the segment of interest in the route at a designated speed.

7. The method of claim 1, wherein the second propulsion-generating vehicle and the first propulsion-generating vehicle are separated by the non-propulsion-generating vehicle in the vehicle system, and remotely controlling the at least one of tractive effort or braking effort provided by the second propulsion-generating vehicle includes changing a position of the non-propulsion-generating vehicle in the vehicle system relative to the second propulsion-generating vehicle consist and the first propulsion-generating vehicle.

8. The method of claim 1, wherein the at least one of tractive effort or braking effort provided by the second propulsion-generating vehicle is remotely controlled from at least one of a stationary building or a mobile handheld operator unit.

9. A control system comprising:

an off-board controller configured to determine that a first propulsion-generating vehicle in a vehicle system is no longer communicable with from a location that is off-board the vehicle system to remotely control tractive effort or braking effort of the first propulsion-generating vehicle, wherein the vehicle system also includes a non-propulsion-generating vehicle, wherein the controller is configured to identify a second propulsion-generating vehicle in the vehicle system to remotely control and to position the non-propulsion-generating vehicle at a designated location by remotely controlling at least one of tractive effort or braking effort provided by the second propulsion-generating vehicle, the at least one of tractive effort or braking effort provided by the second propulsion-generating vehicle being remotely controlled by the controller without also remotely controlling tractive effort or braking effort provided by the first propulsion-generating vehicle in the vehicle system.

10. The control system of claim 9, wherein the controller is configured to identify the second vehicle system in a consist other than a lead consist of the vehicle system to remotely control while the vehicle system is operating in a distributed power (DP) configuration.

11. The control system of claim 9, wherein the controller is configured to remotely control the at least one of tractive effort or braking effort provided by the second propulsion-generating vehicle independent of the tractive effort or the braking effort provided by the first propulsion-generating vehicle.

12. The control system of claim 9, wherein the controller is configured to remotely control the at least one of tractive effort or braking effort provided by the second propulsion-generating vehicle in order to position the non-propulsion-generating vehicle at the designated location in a segment of a route used to one or more of load the at least one of cargo or passengers onto the non-propulsion-generating vehicle or unload the at least one of cargo or passengers from the non-propulsion-generating vehicle.

13. The control system of claim 9, wherein the controller is configured to identify the second propulsion-generating vehicle by determining that the first propulsion-generating vehicle is or will be in a communication-restricted area along a route being traveled by the vehicle system location where remote control of the first propulsion-generating vehicle is prevented.

14. The control system of claim 9, wherein the controller is configured to determine when the vehicle system is approaching a segment of interest of a route being traveled by the vehicle system that includes at least one of an uphill grade or downhill grade, the controller also configured to identify the second propulsion-generating vehicle responsive to the controller determining that the vehicle system is approaching the segment of interest.

15. The control system of claim 14, wherein the controller is configured to remotely control the at least one of tractive effort or braking effort provided by the second propulsion-generating vehicle such that the vehicle system travels over the segment of interest in the route at a designated speed.

16. The control system of claim 9, wherein the second propulsion-generating vehicle and the first propulsion-generating vehicle are separated by the non-propulsion-generating vehicle, and the controller is configured to remotely control the at least one of tractive effort or braking effort provided by the second propulsion-generating vehicle by changing a position of the non-propulsion-generating vehicle in the vehicle system relative to the second propulsion-generating vehicle and the first propulsion-generating vehicle.

17. The control system of claim 9, wherein the controller is configured to remotely control the at least one of tractive effort or braking effort provided by the first propulsion-generating vehicle from a stationary building.

18. The control system of claim 9, wherein the controller is included in a mobile handheld operator unit.

19. A control system comprising:

a controller disposed off-board the vehicle system and configured to determine when communication with a first propulsion-generating vehicle in a vehicle system is prevented and to identify a second propulsion-generating vehicle in the vehicle system, the controller configured to position a non-propulsion-generating vehicle in the vehicle system at a designated location along a route by wirelessly communicating one or more data signals to the second propulsion-generating vehicle to independently control at least one of tractive effort or braking effort provided by the second propulsion-generating vehicle without also remotely controlling tractive effort or braking effort provided by the first propulsion-generating vehicle.

20. The control system of claim 19, wherein the controller is configured to communicate the one or more data signals to increase the tractive effort provided by the second propulsion-generating vehicle to compensate for a decrease in the tractive effort provided by the first propulsion-generating vehicle due to a loss in communication with the first propulsion-generating vehicle.

21. The control system of claim 19, wherein the controller is configured to communicate the one or more data signals to increase the braking effort provided by the second propulsion-generating vehicle to compensate for a decrease in the braking effort provided by the first propulsion-generating vehicle due to a loss in communication with the first propulsion-generating vehicle.

* * * * *